US005898121A

United States Patent [19]

Riboloff

[11] Patent Number: 5,898,121

[45] Date of Patent: Apr. 27, 1999

[54] ELECTRICAL MUSICAL INSTRUMENT PICKUP SYSTEM INCLUDING SWITCHABLE SERIES-CONNECTED HUM-CANCELING WINDINGS

[75] Inventor: John T. Riboloff, Antioch, Tenn.

[73] Assignee: Gibson Guitar Corp., Nashville, Tenn.

[21] Appl. No.: 08/676,968

[22] Filed: Jul. 8, 1996

[51] Int. Cl.[6] ..... G10H 3/00; G10H 3/12

[52] U.S. Cl. ..... 84/728; 84/725; 84/742

[58] Field of Search ..... 84/723, 725–728, 84/742, 743

[56] References Cited

U.S. PATENT DOCUMENTS

| | | | |
|---|---|---|---|
| 3,915,048 | 10/1975 | Stich | 84/1.14 |
| 4,151,776 | 5/1979 | Stich | 84/1.16 |
| 4,164,163 | 8/1979 | Rhodes | 84/1.15 |
| 4,319,510 | 3/1982 | Fender | 84/1.15 |
| 4,408,513 | 10/1983 | Clevinger | 84/1.15 |
| 4,499,809 | 2/1985 | Clevinger | 84/1.15 |
| 4,581,974 | 4/1986 | Fender | 84/1.15 |
| 4,581,975 | 4/1986 | Fender | 84/1.15 |
| 5,136,918 | 8/1992 | Riboloff | 84/723 |
| 5,136,919 | 8/1992 | Wolstein | 84/742 |
| 5,311,806 | 5/1994 | Riboloff | 84/728 |
| 5,376,754 | 12/1994 | Stich | 84/728 |

*Primary Examiner*—John W. Cabeca
*Assistant Examiner*—Marlon T. Fletcher
*Attorney, Agent, or Firm*—McAfee & Taft

[57] ABSTRACT

A pickup system for an electrical musical instrument having strings includes two pickup windings to respond to playing of the strings. A third winding is included. A switch connects any of the three windings in electrical series with either of the remaining two windings so that any of three respective pairs of connected windings can be selected. The windings of each of the respective pairs are connected such that interference such as 60-hertz hum is canceled.

3 Claims, 1 Drawing Sheet

ELECTRICAL MUSICAL INSTRUMENT PICKUP SYSTEM INCLUDING SWITCHABLE SERIES-CONNECTED HUM-CANCELING WINDINGS

BACKGROUND OF THE INVENTION

This invention relates generally to pickup systems for electrical musical instruments and more particularly, but not by way of limitation, to switchable hum-canceling windings for electric guitars.

One technique for amplifying the sound of a stringed musical instrument uses electromagnetic pickups positioned beneath the strings of the instrument. Such pickups include one or more coils or windings of wire wrapped around one or more metallic cores or pole pieces which are themselves magnetic or which are magnetized by adjacent magnetic material. The strings of the instrument pass through the magnetic field and cause an electrical signal to be produced in the winding(s) when the strings vibrate within the magnetic field in response to being played. The produced electrical signals correspond to the notes played on the strings, and the electrical signals are electrically amplified and broadcast to create the amplified audible music.

Of particular relevance to the present invention is the single-coil pickup, which is a type of pickup that typically has a brighter tone than a conventional multiple-coil humbucker pickup. This single-coil type of pickup is known to have a shortcoming due to its tendency to respond not only to the adjacent string vibration but also to ambient electromagnetic interference. This interference arises from other electrical devices (e.g., lights, motors, transformers, etc.) in the area which are powered by conventional alternating current power (at a frequency of 60-hertz in the United States, for example). This produces distortion, such as a 60-hertz hum, in the amplified music.

Although this problem is well-known and despite various proposed or implemented solutions for canceling this hum, there is still the need for a hum-canceling pickup system which is relatively simple and inexpensive to implement yet which allows for different tonalities to be selected by the player and which also enables relatively high power output and which still retains the bright tonality of a single-coil pickup.

SUMMARY OF THE INVENTION

The present invention overcomes the above-noted and other shortcomings of the prior art by providing a novel and improved pickup system for an electrical musical instrument, specifically a stringed instrument (e.g., an electric guitar). The pickup system comprises two separate pickup windings for mounting on the musical instrument in electromagnetic relationship with the strings of the instrument. It also comprises a third winding for mounting on the musical instrument so that the third winding is unresponsive to movement of the strings of the instrument and so that the third winding does not significantly affect the active inductance of the two separate pickup windings. The pickup system further comprises switch means for connecting any of the three windings in electrical series with either of the remaining two windings.

In a particular implementation the pickup system is for an electric guitar. This system comprises both a single-coil rhythm pickup mounted on the guitar beneath strings of the guitar and a single-coil treble pickup mounted on the guitar beneath the strings of the guitar and spaced from the rhythm pickup. This electric guitar pickup system also comprises a single-coil winding mounted on the guitar so that the winding is unresponsive to movement of the strings of the guitar and is spaced from the rhythm and treble pickups. Also included is a switch connected to the pickups and the winding. The switch is operable to at least three positions for respectively connecting the winding in electrical series and hum-canceling relationship with either of the pickups or for connecting the rhythm pickup in electrical series and hum-canceling relationship with the treble pickup.

The foregoing provides for a more powerful and efficient pickup system as a result of the series connection of the two selected coils. This is also a relatively simple and inexpensive system, and yet it allows a player to select different tonalities but with the tonalities remaining bright due to placement of the windings relative to each other to prevent tone altering effects one coil could otherwise impose on another if they were placed adjacent each other.

Therefore, from the foregoing, it is a general object of the present invention to provide a novel and improved pickup system for an electrical musical instrument. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENT

Figure 1:
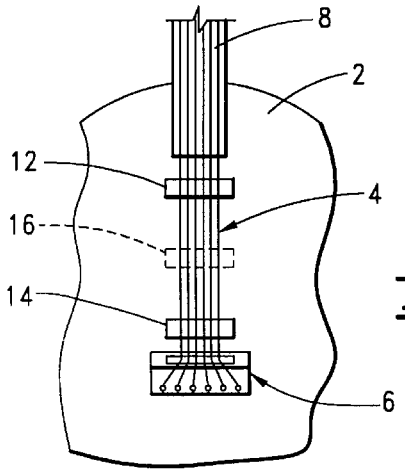
FIG. 1 is a representation of a part of a stringed electrical musical instrument, such as an electric guitar, with which the present invention can be used.

The present invention can be used with any stringed musical instrument 2, as partially represented in FIG. 1, for which electrical amplification is desired. The preferred embodiment of the invention is particularly adapted for use with an electric guitar.

The illustrated instrument 2 has six strings 4, but more or less may be used on various types of musical instruments or different embodiments of a particular type of instrument. The strings 4 are anchored at their lower end (as viewed in FIG. 1) in conventional manner near a bridge 6, and they are connected at their upper ends to tuning screws (not shown) located at the upper end of a fingerboard 8.

Figure 2:
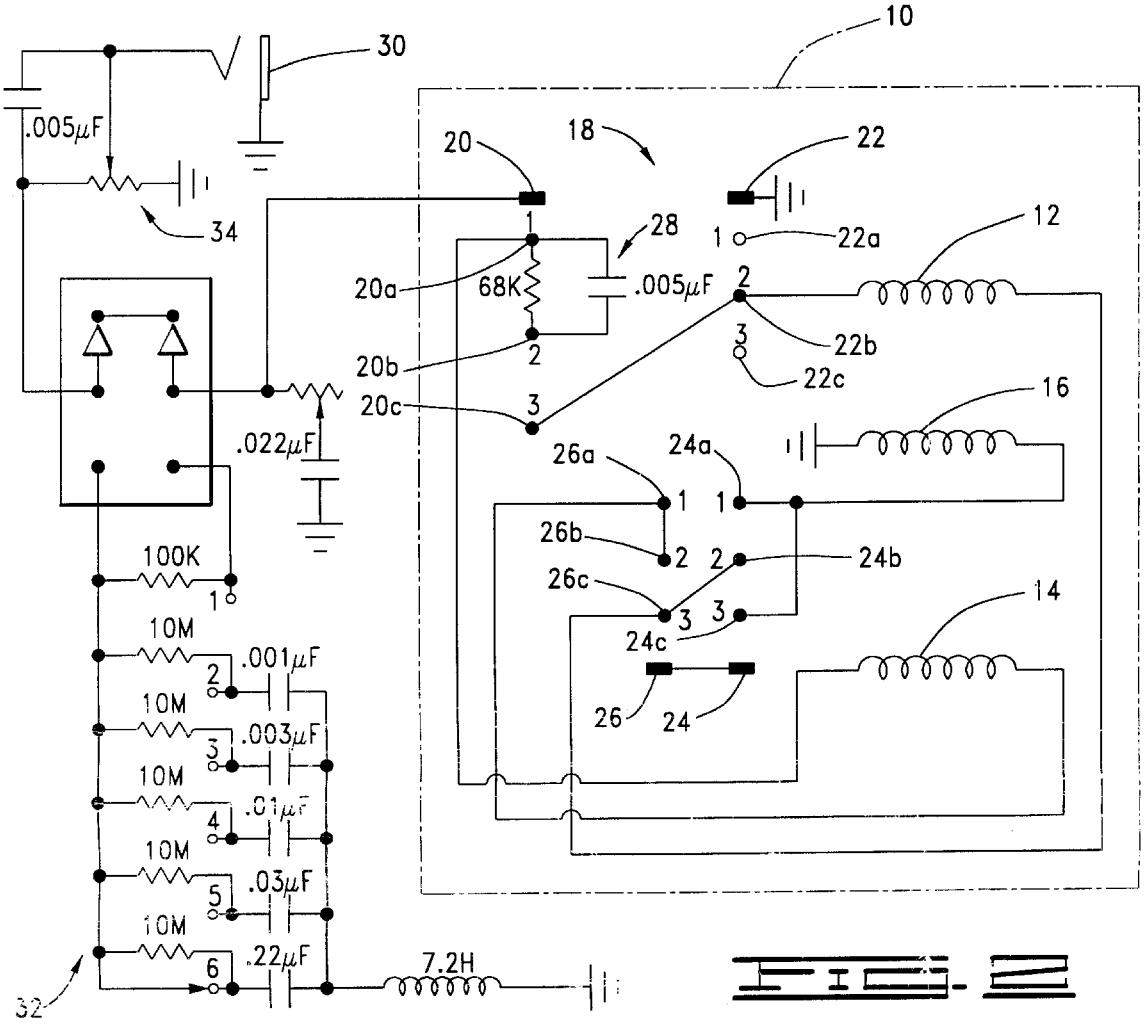
FIG. 2 is a schematic circuit diagram of the pickup system of the present invention and one means for connecting it to an output jack of the instrument.

Mounted on and within the instrument 2 in a conventional manner is a pickup system 10 having the preferred embodiment shown in FIG. 2. Referring to FIG. 2, the pickup system 10 of the preferred embodiment includes three single-coil windings 12, 14, 16 and a switch 18.

The winding 12 constitutes the rhythm or neck or front pickup located beneath the strings 4 near the fingerboard 8 as shown in FIG. 1. Included with the single coil of the winding 12 are one or more pole pieces which are magnetic or magnetized. These are of conventional type and are mounted with the winding coil on the instrument 2 in a manner such that the pickup 12 is in an electromagnetic relationship with the strings 8. In the preferred embodiment, the magnetic relationship is in a first orientation, such as with the south magnetic pole oriented closer to the strings 8 than the north magnetic pole. The specific construction and mounting of the winding 12 on the instrument 2 are as well known in the art.

The winding 14 is mounted on the instrument 2 closer to the bridge so that it is referred to as a treble or bridge or lead pickup. It is also located beneath the strings 8 and is otherwise the same as the winding 12 in the preferred embodiment except that the magnetic orientation of the pole piece(s) of the winding 14 is in an opposite orientation relative to the field of the winding 12 (e.g., the north magnetic pole is closer to the strings 8 than the south magnetic pole of the pole piece(s) of the winding 14).

The winding 16 may be referred to as a dummy winding in that it is unresponsive (at least to any significant degree) to the movement of the strings 8. Although dashed lines are used in FIG. 1 to represent the winding 16 as being mounted below the surface of the instrument 2 beneath the strings 8, in general the winding 16 is to be located so that it is not responsive to movement of the strings and so that it does not affect the operation of either the winding 12 or the winding 14 when it is connected to such winding other than to cancel induced interference such as alternating current hum. To accomplish this hum-canceling without other effect, the winding 16 should be substantially identical to the windings 12 and 14 except that it does not include a magnetic element. In the preferred embodiment, the winding 16 does not even include any metallic pole piece. Further so that the winding 16 does not otherwise affect either of the windings 12, 14, the winding 16 is positioned from the windings 12, 14 by a distance sufficient to prevent significant interactive inductance between the coils. That is, the winding 16 should not significantly affect the active inductance of either of the pickup windings 12, 14 so that the desired response of the windings 12, 14 is substantially the same with the winding 16 as with it absent, except for the reduction in hum. For example, the coils of windings 12, 14, 16 should not be in direct contact or immediately adjacent position with each other or otherwise positioned equivalently to a single-package dual-winding humbucker of known type. One suitable positioning of the windings is shown in FIG. 1 with the winding 16 substantially equidistant between the windings 12, 14; however, other spatial relationships can be used. With such a winding 16, the present invention retains the brighter single-coil sound desired from the coils 12, 14 but with the added benefit of hum-canceling.

Specific design parameters for the windings 12, 14, 16 of a specific implementation which does not limit the scope of the invention are as follows. Each winding comprises a single coil of 7,200 turns of 42 AWG magnet wire. The windings 12, 14 also have pole pieces made of permanent magnetic material, specifically ALNICO II. These materials are well-known in the art.

The windings 12, 14, 16 are selectably interconnected by the switch means 18 which is used for connecting any of the three windings in electrical series with either of the remaining two windings. The connections between any two of the windings is made such that the two windings are connected with opposite winding directions relative to each other to achieve the desired hum canceling of the present invention. When the switch 18 is operated to a respective one of three positions, a respective pair of the windings are connected in a hum-canceling, electrical series relationship.

In the preferred embodiment, the switch 18 is a four-pole, triple-throw (three position) switch (it is illustrated as a slide switch, but other types can be used). The four poles are identified in FIG. 2 by the reference numbers 20, 22, 24, 26. For the three positions of the switch, there are three terminals associated with each pole. Associated with the pole 20 are terminals 20*a*, 20*b*, 20*c*; associated with pole 22 are terminals 22*a*, 22*b*, 22*c*; associated with pole 24 are terminals 24*a*, 24*b*, 24*c*; and associated with pole 26 are terminals 26*a*, 26*b*, 26*c*. Each of the "a" terminals is electrically connected with its respective pole when the switch is in its first position, and each of the "b" terminals is connected to its respective pole in the switch's second position, and each of the "c" terminals is connected to its respective pole when the switch is in its third position. These terminals are connected to the windings 12, 14, 16 as illustrated in FIG. 2.

As shown in FIG. 2, one end of the rhythm pickup 12 is connected to the third-position terminal 20*c* associated with pole 20 and it is also connected to second-position terminal 22*b* associated with pole 22. The other end of the winding 12 is connected to the second-position terminal 24*b* associated with pole 24 and to third-position terminal 26*c* associated with pole 26.

The treble pickup 14 has one end connected both to first-position terminal 20*a* and second-position terminal 20*b* associated with pole 20. Connection of this end of the winding 14 to terminal 20*b* is through the illustrated resistor-capacitor network 28 shown in FIG. 2. The resistor-capacitor network is used to equalize the output at switch position 2 relative to positions 1 and 3. The other end of the winding 14 is connected to both first-position terminal 26*a* and second-position terminal 26*b* associated with pole 26.

The dummy winding 16 has one end connected to electrical ground and the other end connected to both first-position terminal 24*a* and third-position terminal 24*c* associated with pole 24.

With the connections shown in FIG. 2, the following table shows which windings are connected in hum-canceling electrical series relationship for each of the first, second and third positions of the switch 18.

| Switch Position | Winding Connections |
|---|---|
| 1 | winding 14 in series with winding 16 |
| 2 | winding 14 in series with winding 12 |
| 3 | winding 12 in series with winding 16 |

These different combinations or pairs of windings enable different tonalities to be sounded due to the differently located single pickup winding 12 or 14 which produces the sound in position 3 or 1, respectively, and due to the dual pickup windings 12, 14 used together in position 2. Yet, in all of these positions hum-canceling occurs due to the use of the dummy winding 16 in switch positions 1 and 3 and the non-use of winding 16 in switch position 2 where it is not needed because of the hum-canceling achieved by the two pickup windings 12, 14 connected in this switch position. Furthermore, because of the spacing of the windings, this hum-canceling occurs without affecting the desired bright response of the single-coil windings 12, 14.

With one of the foregoing combinations of windings selected through the switch 18, the output therefrom is provided through the pole 20 which is connected in the preferred embodiment to an output jack 30 mounted on the instrument 2 in known manner. The output jack 30 receives a plug from an electrical cable extending to the preamplifier or amplifier equipment of suitable type known in the art.

The output from the pole 20 is connected to the output jack 30 by suitable connecting means which in FIG. 2 includes a tone control circuit 32 and a volume control circuit 34. Known types of these are illustrated in FIG. 2. These do not form part of the present invention; therefore, they will not be further described. Furthermore, it is to be noted that other types of interconnection or communication circuitry can be used for transferring the output from the pickup system of the present invention to its ultimate point of use.

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. A pickup system for an electric guitar, comprising:

a single-coil rhythm pickup mounted on the guitar beneath strings of the guitar, said rhythm pickup including a respective single coil and a respective magnet disposed in a first magnetic orientation;

a single-coil treble pickup mounted on the guitar beneath the strings of the guitar and spaced from said rhythm pickup, said treble pickup including a respective single coil and a respective magnet disposed in a second magnetic orientation different from the first magnetic orientation;

a single-coil winding mounted on the guitar without a magnet so that said winding is unresponsive to movement of the strings of the guitar and is spaced from said rhythm and treble pickups, said winding having one end fixed to electrical ground; and a switch connected to both ends of the respective single coil of each of said rhythm pickup and said treble pickup and to the other end of said winding from the end thereof fixed to electrical ground, said switch operable to at least three positions wherein at one of the three positions the switch connects said winding in electrical series and hum-canceling relationship with one of said pickups, and wherein at another of the three positions the switch connects said winding in electrical series and hum-canceling relationship with the other of said pickups; and further wherein at yet another of the three positions the switch connects said rhythm pickup in electrical series and hum-canceling relationship with said treble pickup.

2. A pickup system as defined in claim 1, wherein:

said switch includes four poles and associated terminals defined with regard to the at least three positions;

said rhythm pickup has a first end of the single coil thereof connected both to a third-position terminal associated with a first pole of said switch and to a second-position terminal associated with a second pole of said switch, and said rhythm pickup has a second end of the single coil thereof connected both to a second-position terminal associated with a third pole of said switch and to a third-position terminal associated with a fourth pole of said switch;

said treble pickup has a first end of the single coil thereof connected both to a first-position terminal and a second-position terminal associated with the first pole of said switch, and said treble pickup has a second end of the single coil thereof connected to both a first-position terminal and a second-position terminal associated with the fourth pole of said switch;

said winding has a first end of the single coil thereof connected to an electrical ground, and said winding has a second end of the single coil thereof connected to both a first-position terminal and a third-position terminal associated with the third pole of said switch; and the first pole of said switch provides an output from said pickup system, the second pole of said switch is connected to the electrical ground, and the third pole of said switch is connected to the fourth pole of said switch.

3. A pickup system as defined in claim 2, further comprising a resistor-capacitor network connecting the first end of the single coil of said treble pickup to the second-position terminal associated with the first pole of said switch.

* * * * *